US005169195A

United States Patent [19]

Kirchhoff

[11] Patent Number: 5,169,195

[45] Date of Patent: Dec. 8, 1992

[54] CONTAINER HANDLING EQUIPMENT

[75] Inventor: Johannes Kirchhoff, Iserlohn, Fed. Rep. of Germany

[73] Assignee: Edelhoff Polytechnik GmbH & Co., Iserlohn, Fed. Rep. of Germany

[21] Appl. No.: 671,007

[22] Filed: Mar. 18, 1991

Related U.S. Application Data

[62] Division of Ser. No. 483,053, Feb. 21, 1990, Pat. No. 5,114,297.

[51] Int. Cl.[5] ..... B65F 3/04; B65F 9/18

[52] U.S. Cl. ..... 294/68.26; 414/422; 414/626

[58] Field of Search ..... 414/406, 408, 409, 422, 414/540, 558, 618-622, 601, 624; 187/9 R, 9 E; 294/68.1, 81.51, 68.26

[56] References Cited

U.S. PATENT DOCUMENTS

| | | | |
|---|---|---|---|
| 2,650,732 | 9/1953 | Hartquist . | |
| 2,772,800 | 12/1956 | Brady . | |
| 3,015,402 | 1/1962 | Norton et al. . | |
| 3,016,157 | 1/1962 | Brisson | 294/68.3 X |
| 3,262,729 | 7/1966 | Willison et al. | 294/81.51 X |
| 3,272,364 | 9/1966 | Mindrum et al. . | |
| 3,670,912 | 6/1972 | Dunbar | 294/68.26 X |
| 4,029,229 | 6/1977 | Hobson . | |
| 4,671,724 | 6/1987 | Bolton | 294/81.51 X |
| 4,715,767 | 12/1987 | Edelhoff et al. | 414/408 |
| 4,936,732 | 1/1990 | Naab et al. | 414/408 |

FOREIGN PATENT DOCUMENTS

| | | | |
|---|---|---|---|
| 940168 | 1/1974 | Canada | 294/68.3 X |
| 0235784 | 4/1985 | European Pat. Off. . | |
| 1059353 | 6/1959 | Fed. Rep. of Germany . | |
| 1882477 | 9/1963 | Fed. Rep. of Germany . | |
| 1160594 | 1/1964 | Fed. Rep. of Germany | 414/422 |
| 1919085 | 7/1965 | Fed. Rep. of Germany . | |
| 3024659 | 2/1982 | Fed. Rep. of Germany . | |
| 3543224 | 10/1986 | Fed. Rep. of Germany . | |
| 3902177 | 6/1990 | Fed. Rep. of Germany . | |
| 941271 | 7/1982 | U.S.S.R. | 294/68.26 |
| 1184790 | 10/1985 | U.S.S.R. | 294/81.51 |
| 1545555 | 5/1979 | United Kingdom . | |

OTHER PUBLICATIONS

Soviet Inventions, Illustrated of Feb. 2, 1984 Containerumschlag, Derwent Publications Ltd. DE-Z.: Fordern und Heben 37, 1987 Nr. 12, S. 892 FIGS. 7,9.

*Primary Examiner*—David A. Bucci
*Attorney, Agent, or Firm*—Morgan & Finnegan

[57] ABSTRACT

A conveying and/or handling device for containers has a plurality of coupling claws, and latching members cooperating with the latter essentially in the manner of tongs. In order to provide for simple handling of all types of containers and to load and move them about, two coupling claws are provided on a transverse bearer or beam of a lifting carriage. The transverse bearer or beam carrying the coupling claws runs in vertical guideways on the lifting carriage for vertical motion and is driven by a hydraulic piston and cylinder unit. The lifting carriage is provided with at least one fork or supporting plate to be placed under the floor of the container. The carriage runs in guideways of the vertical beams of a lifting rig and is driven by a hydraulic drive unit.

3 Claims, 2 Drawing Sheets

CONTAINER HANDLING EQUIPMENT

This is a divisional of co-pending application Ser. No. 07/483,053 filed Feb. 21, 1990, now U.S. Pat. No. 5,114,297.

The invention relates to a conveying or handling device for large containers, or the like, comprising a plurality of coupling claws, preferably having an essentially triangular configuration with upwardly directed apexes, each of which has an essentially flat rear face and a convex, spherically curved front face which in cross section converges at the rear face defined by the sides of the triangle and at an acute angle with the rear face, and latching members adapted to cooperate with the coupling claws essentially in the manner of tongs.

BACKGROUND OF THE INVENTION

Lifting and rocking devices with coupling claws of the type generally set forth above are described, for example, in European pre-examination specification 235,784, German utility model specification 8,519,096, and German pre-examination specification 3,639,861. Such coupling claws cooperate with essentially complementary receiving sockets on garbage containers and have proved successful as self-centering engaging means.

It is an object of the present invention to provide a conveying and/or handling device of the initially mentioned type which may be utilized with containers of all types, and to provide a simple means of handling, loading and conveying such containers.

SUMMARY OF THE INVENTION

In accordance with the invention, the above object is attained by providing a conveying and/or handling device of the type mentioned comprising a plurality of coupling claws located on a transverse bearer or beam of a lifting carriage, the transverse bearer or beam carrying the coupling claws being guided in vertical guideways located on the lifting carriage and movable longitudinally by a hydraulic piston and cylinder actuator, the lifting carriage having at least one fork or support plate adapted to fit under the floor of a container and which is located on the lower part of the lifting carriage below the transverse bearer or beam and which is able to be shifted in guideways located on upright members of a lifting rig or the like by drive means, such as, for example, a hydraulic piston and cylinder actuator.

The device in accordance with the invention may be coupled in a simple manner with a container since the fork or support plate may be moved into position under the floor of the container and then the transverse bearer or beam may be raised in such a manner that the coupling claws are brought into engagement with complementary claw sockets on the container and the fork or the support plate takes up a supporting position under the floor of the container.

The lifting rig may be the lifting rig or mast of a fork list or other industrial truck. Such a fork lift or other industrial truck may be front or lateral stacking vehicles. Such trucks may, for example, be used for placing containers on container shelving, as well. The lifting rig may also be installed, for example, at a container terminal as a stationary piece of equipment.

Furthermore, the lifting rig may be arranged to rock, so that the container coupled with the lifting carriage may also be tipped for discharging.

A container to be conveyed and handled with the conveying and handling device in accordance with the invention is provided with two claw sockets which are placed in a spaced relationship with respect to each other on one side of the container at a lower level than the stiffened upper edge thereof. The claw sockets are complementary to the coupling claws and open in a downward direction. A joist is provided on the container and extends parallel to one side thereof so that its distance from the side wall of the container is equal to the length of the fork or plate. A container so constructed may be coupled in a particularly simple manner with the conveying and/or handling device in accordance with the invention by inserting the fork prongs or the support plate under the container and towards the joist until they strike against the joist and then moving the transverse bearer or beam on the carriage with the coupling claws outwardly from the carriage, so that the coupling claws run into the sockets.

It is preferred that the fork prongs or the support plate merge with a foot part thereof having a curvature whose shape essentially corresponds to the arcuate part joining one side wall of the container with the floor of the container. Such adaptation of the fork prongs or the plate with the form of the container favors an interlocking coupling action between the container and the conveying and/or handling device.

In accordance with a further modification of the invention in the context of a conveying or handling device for containers, such as lift vans and large garbage containers or the like, the device comprises a plurality of coupling claws, preferably having an essentially triangular configuration with upwardly directed apexes, each claw having an essentially flat rear face and a convex, spherically curved front face, which in cross section converges at the face defined by the sides of the triangle and at an acute angle with the rear face. In such an arrangement, the object of the invention is achieved by providing a carrying frame on opposite girder members of the device and which carrying frame is provided with a respective lever whose lower free end bears the coupling claw. Such a conveying and/or handling device may be employed, for example, as a loading harness for so-called spreaders, as mentioned, for example, in the German pre-examination specification 3,315,889. In such an arrangement, the carrying frame, which may conveniently be provided at its four corners with rope or chain slings, may also be provided on opposite sides, respectively, with one or two levers bearing coupling claws.

The carrying frame in accordance with the invention provides a simple means for lifting and transferring containers at container terminals, such as, for example, harbor or railroad container terminals, or at garbage container handling installations.

In order to fit around the complementary sockets of the containers in a simple manner, the levers are preferably designed to rock so that when the carrying frame is lowered they may be moved past the sockets without obstruction, and then swung into a position from which they may be moved on lifting the carrying frame so as to fit into the sockets.

In a corresponding manner, the containers may be provided on opposite sides with one or two respective sockets at a lower level than the upper stiffening edge of the container.

THE DRAWINGS

Working embodiments of the invention will now be described in detail with reference to the Drawings and in which Drawings:

FIG. 1 is a front elevation of the lifting carriage of a conveying and handling device for containers in accordance with the invention;

FIG. 1*a* is a plan view, taken across Line 1*a*—1*a* of FIG. 1, of a lateral bearer or beam of the lifting carriage illustrated in FIG. 1;

FIG. 2 is a partial lateral elevational view of the device illustrated in FIG. 1;

FIG. 2*a* is a plan view in section taken across Line 2*a*—2*a* of FIG. 2 showing the disposition of shoes fitted into the T-slots of the vertical bearers of the lifting carriage;

Figures 5, 6, 6A, 7, 8, 9:
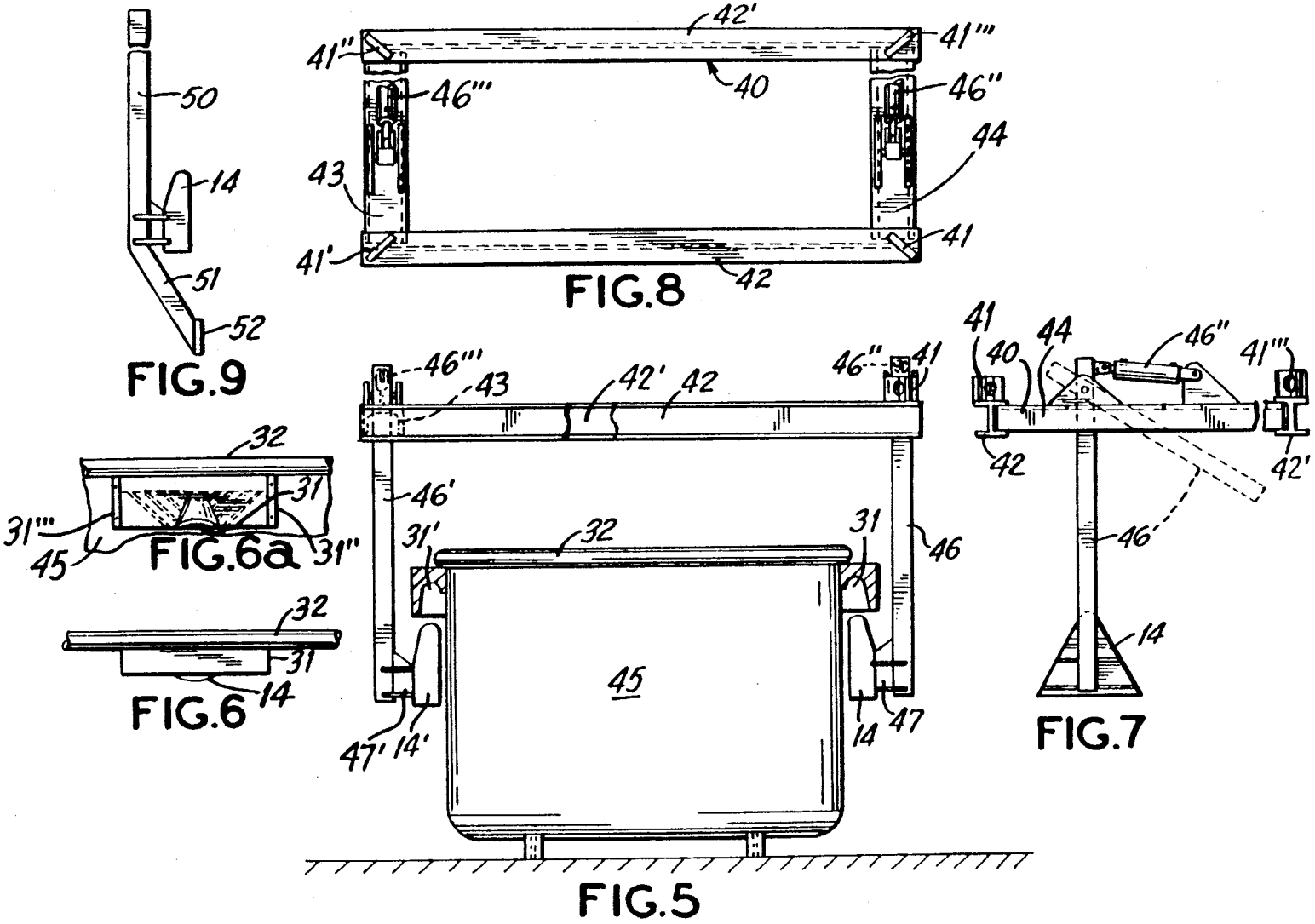
FIG. 5 is a front elevational view of a modification of a lifting frame according to the invention illustrating coupling claws borne on levers.
FIG. 6 is a plan view of a socket attached to the container.

FIG. 6*a* is a side view partially in section of a socket attached to the container;

FIG. 7 is a side view partially in section of the lever carrying a coupling claw;

FIG. 8 is a plan view of the lifting frame shown in FIG. 5; and

FIG. 9 is a lateral, elevational view of a lever bearing a coupling claw together with the extending support arm.

DESCRIPTION OF THE PREFERRED EMBODIMENTS

Figures 1, 1A, 2, 2A, 3, 4:
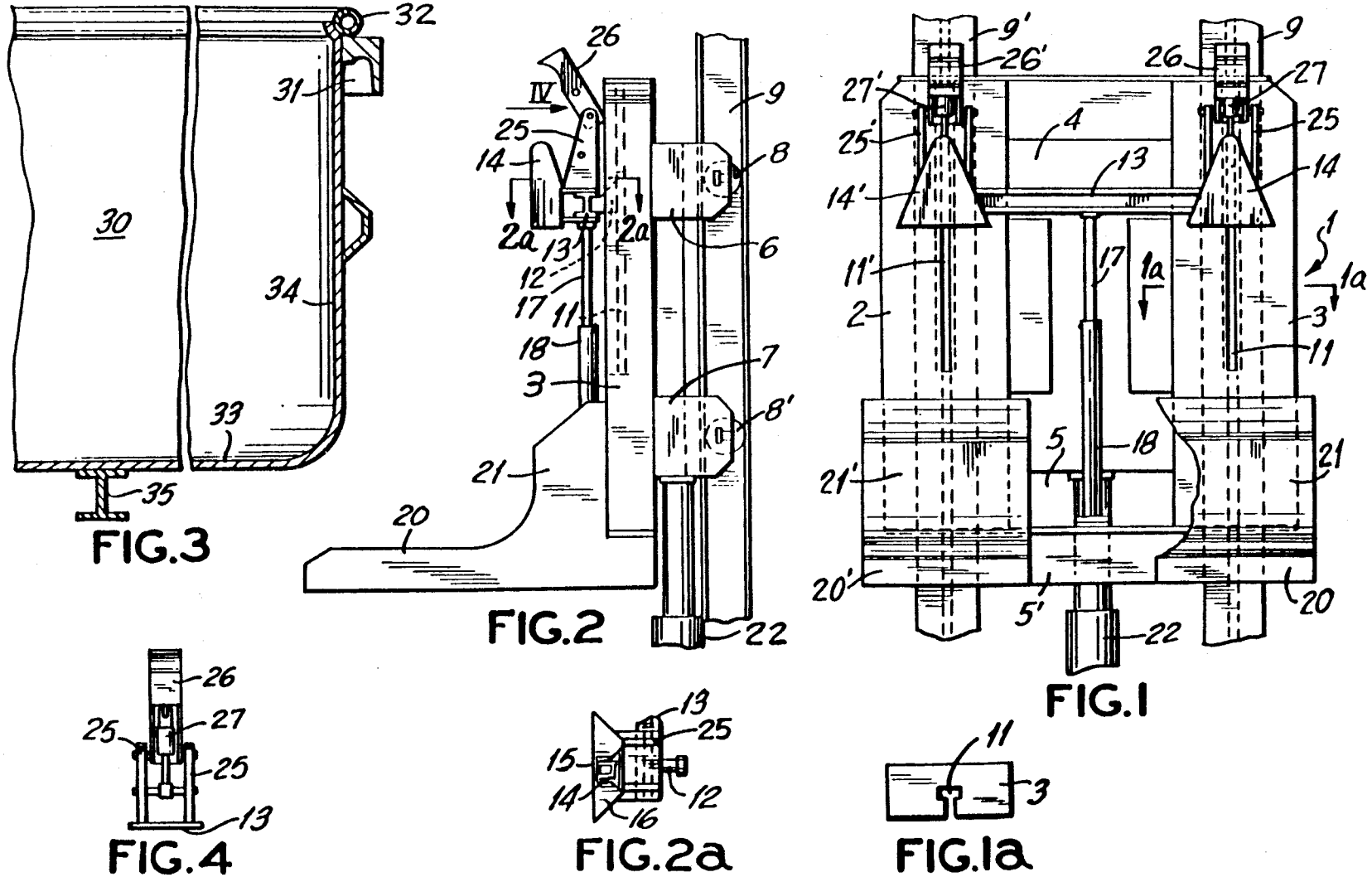
FIG. 3 is a partial sectional elevational view taken through a container to be handled by the device illustrated in FIGS. 1 and 2.
FIG. 4 is a front elevational view of the latching device of the lifting carriage taken in the direction of the arrow IV of FIG. 2.

Referring now to FIG. 1, a conveying and/or handling device according to the invention comprises a lifting carriage 1 composed of lateral bearers or beams 2 and 3, which are joined together by transverse bearers 4 and 5 to form a frame. On its rear side, the lifting carriage is provided respectively with two upper and two lower bearing units 6 and 7 (FIG. 2) attached to transverse bearers, one of which 5' is shown in FIG. 1 and in which bearing units rolls 8 and 8' are mounted and run in channelled girders forming the vertical bearers or beams 9 and 9' (FIG. 1) of the lifting rig. In this respect, the rolls 8 and 8' are arranged to run between the inner sides of the flanges of the vertical bearers of the lifting rig.

The lateral bearers or beams 2 and 3 of the lifting carriage 1 are provided with guideway T-slots, 11, 11' (FIG. 1) such as shown in FIG. 1*a* by numeral 11, into which the T-heads (FIG. 2*a*) of suitably shaped shoes 12 fit. The shoes 12 are secured to the rear side of a transverse bearer or beam 13, which at its ends bears generally triangular coupling claws 14, 14' (FIG. 1) and claw 14 being shown in greater detail in FIGS. 2 and 2*a*. These coupling claws 14 14' have an outer flat support surface 15 and a spherically curved rear surface 16 which generally has the form of a portion of a cone with a section surface parallel to the axis of the cone (FIG. 2*a*). The transverse bearer or beam 13 is centrally connected with a piston rod 17 of a hydraulic cylinder actuator 18 which is secured in any convenient manner to the lower transverse bearer or beam 5 of the lifting carriage 1, as shown in FIG. 1.

The lifting carriage 1 has fork prongs 20, 20' mounted on its lower end which merge with foot members 21, 21' via fillets (FIGS. 1 and 2).

The lifting carriage is able to be moved while running in the channelled guideways of the vertical bearers or beams 9 and 9' of the lifting rig by a hydraulic piston and cylinder actuator 22, which is secured in any convenient manner to transverse beams 5', as shown in FIGS. 1 and 2.

Latching levers 26, 26' (FIG. 1) are pivotally mounted to the transverse bearer 13 by projecting bearing members 25, 25' (FIG. 1) and they are able to be rocked by means of fluid power piston and cylinder actuators 27 and 27', such as piston and cylinder actuator 27 shown in greater detail in FIG. 4. In coupled condition with a container 30 in which the coupling claws 14, 14' fit into the complementary coupling sockets 31, 31', these latching levers 26, 26' engage the upper reinforcing edge or rim 32 extending around the container 30.

Under the floor 33 of each such container 30 a joist 35 is provided which runs parallel to a side wall 34 of the container. In the illustrated working embodiment, the joist 35 is in the form of an H-girder. For coupling with the container 30, the fork prongs 20, 20' of the lifting carriage 1 are inserted under the container 30 and moved far enough so that they abut against the joist. The hydraulic piston and cylinder actuator 17 and 18 is then extended so that the coupling claws 14, 14' run into the sockets 31, 31'. Then, the latching levers 26, 26' are pivoted to engage the container edge 32 so that the container is locked to the lifting carriage 1.

In the modified embodiment illustrated in FIGS. 5 through 8, a rectangular lifting frame 40, comprising beams 42, 42', 43 and 44, (FIG. 8), is provided. Frame 40 has eyes 41, 41', 41'' and 41''' at its corners for the attachment of rope or chain slings for attaching the lifting carriage frame to a lifting rig, such as those mentioned above, or to a lifting crane or the like. Depending upon the size of the container 45 to be handled and shifted, carrying levers 46 and 46' are pivotally mounted on the beams 43 and 44. The carrying levers 46 and 46' have their lower ends connected with coupling claws 14 and 14' via intermediate spacer members 47 and 47'. These coupling claws 14 and 14' are complementary to the sockets 31 and 31' which are arranged under the container edge 32 on the side walls of the same.

FIG. 6 shows a socket 31 attached to one side of the container 45 in plan view, and to the side of the container in a lateral view in FIG. 6*a*. As shown in FIG. 6*a*, the socket 31 may be attached to the side of container 45 by riveted flanges 31'' and 31''', or in any other convenient manner.

As shown in greater detail in FIG. 7, the carrying levers 46 and 46' are in the form of first class levers with the shorter lever arms projecting past the carrying frame 40 and being pivotally connected to piston rods of fluid powered piston cylinder actuators 46'' and 46''', such as piston cylinder actuator 46'', whose cylinder is connected in a pivoting manner with the carrying frame 40 as illustrated.

In the embodiment shown in FIG. 9, the carrying levers, such as carrying lever 50, have angled support arms, such as arm 51, which extend past the coupling claws, such as claw 14. At their ends the support arms, such as arm 51, are provided with support plates, such as plate 52, which bear against the walls of the container when lifting takes place. Carrying levers of this sort are more particularly suitable if the containers to be handled are only provided with two sockets.

What is claimed is:

1. A conveying and handling device for a container comprising a rectangular support frame disposed in a horizontal plane and made from a plurality of connected beams and provided with attaching means at the corners thereof for the reception of slings, a carrying lever located on each beam of a pair of the beams of said rectangular support from which are disposed opposite each other, each said carrying lever having located thereon in the vicinity of its lower end a coupling claw, said coupling claw having an essentially triangular configuration with an upwardly directed apex, an essentially flat rear face and a convex, spherically curved front face which in cross section converges at the face defined by sides of the triangle and at an acute angle with the rear face, each carrying lever provided with an angled arm which extends past the coupling claw and which has a support face at an end bearing directly against a container sidewall.

2. A conveying and handling device for a container according to claim 1 wherein each carrying lever is pivotally mounted on the support frame and is provided with a pivoting drive.

3. A conveying and handling device for a container according to claim 1 wherein each carrying lever is rocked by a hydraulic piston and cylinder actuator.

* * * * *